US008332986B2

(12) United States Patent
Hu

(10) Patent No.: US 8,332,986 B2
(45) Date of Patent: Dec. 18, 2012

(54) SCREW TYPE MOP HOLDER

(75) Inventor: GuoMing Hu, Taizhou (CN)

(73) Assignee: Yinshang Mfg Brushes Co., Ltd., Taizou (CN)

( * ) Notice: Subject to any disclaimer, the term of this patent is extended or adjusted under 35 U.S.C. 154(b) by 832 days.

(21) Appl. No.: 12/458,296

(22) Filed: Jul. 8, 2009

(65) Prior Publication Data

US 2010/0175210 A1 Jul. 15, 2010

(30) Foreign Application Priority Data

Jan. 15, 2009 (CN) ..... 2009 2 0002830 U

(51) Int. Cl.
*A47L 13/00* (2006.01)

(52) U.S. Cl. ..... 15/153; 15/147.1

(58) Field of Classification Search ..... 15/147.1, 15/150, 151, 153, 149, 231, 145, 143.1
See application file for complete search history.

(56) References Cited

U.S. PATENT DOCUMENTS

| | | | | | |
|---|---|---|---|---|---|
| 64,683 | A * | 5/1867 | Mason et al. | ..... | 15/153 |
| 82,383 | A * | 9/1868 | Clark et al. | ..... | 15/153 |
| 1,575,058 | A * | 3/1926 | Johnson | ..... | 15/153 |
| 2,431,564 | A * | 11/1947 | Jumonville | ..... | 15/153 |
| 4,287,632 | A * | 9/1981 | Hammond | ..... | 15/150 |
| 5,345,643 | A * | 9/1994 | Tomm | ..... | 15/147.1 |

* cited by examiner

*Primary Examiner* — Laura C Guidotti

(57) ABSTRACT

A mop holder which provides fast changing of mop cloth and ease of use is characterized in that a shaft (5) is disposed on a middle top of the frame (1); and a circular groove (6) is set on an inner bottom of the shaft (5). A tube (7) which fits into said shaft (5) is screw jointed onto an outer bottom of a handle (3); and a projection (9), corresponding to said groove (6) is disposed on a bottom of said tube (7). Said projection (9) comprises pluralities of slots (8), disposed on a surface thereof; and a tapered surface (10) for guiding said tube (7) into the shaft (5) is disposed on an outer bottom of said projection (9). By coupling the projection (9) and groove (6), said tube (7) is partially fitted into the shaft (5) firmly and allowed to rotate freely therein.

8 Claims, 5 Drawing Sheets

SCREW TYPE MOP HOLDER

FIELD OF THE INVENTION

The present invention relates to a screw type mop holder.

BACKGROUND OF THE INVENTION

A Mop is a tool commonly used for house cleaning, and a mop holder is a device for fixing the mop cloth. A conventional mop holder usually comprises a frame, a limb and a screw. The limb is jointed with the screw and is placed in an inner area of the frame, forming a space between the limb and frame. A shaft and a nut are further mounted on the frame. When changing a mop cloth, said nut which corresponds and joints with said screw is rotated, forcing the screw to move up/downwardly and causing reaction of the limb to release and hold the mop cloth. By size of the nut, a user usually can rotate by using thumb and index finger, causing difficulty when clamping the mop cloth. This technique also generates pain and discomfort.

SUMMARY OF THE INVENTION

A mop holder which can hold the mop efficiently and generates no pain or discomfort can be achieved in two different types. A first type of mop holder consists essentially of a frame (1), a limb (2) and a threaded handle (3). Said limb (2) is fixed to a bottom of the handle (3) and is disposed in an inner area of the frame (1), forming a space (4) between the limb (2) and frame (1) for accommodating a mop cloth (18).

Said screw type mop holder is characterized in that: a shaft (5) is disposed on a top of the frame (1) and a circular groove (6) is set on an inner bottom of the shaft (5).

An opening (16) is disposed on a side of the frame (1); a hook (11) is disposed on a side of said opening (16), and a free end of said hook (11) corresponds with said opening (16).

A rail (17) is disposed on both sides of the limb (2), and a projecting bar (12) which corresponds with said rail (17) is disposed on both inner sides of the frame (1) for guiding the limb (2).

A tube (7) which fits into said shaft (5) is screw jointed onto an outer bottom of the handle (3) and pluralities of anti-slip stripes (13) are disposed on an outer top of the tube (7). A circular projection (9), corresponding to said groove (6) is disposed on a bottom of said tube (7). Said projection (9) comprises pluralities of slots (8) around a side wall thereof, and a tapered surface (10) for guiding said tube (7) into the shaft (5) is disposed on an outer bottom of said projection (9).

By coupling the projection (9) and groove (6), said tube (7) is fitted into the shaft (5) firmly and allowed to rotate freely therein.

The second type of mop holder includes a frame (1), a limb (2) and a threaded handle (3); said limb (2) is fixed to a bottom of the handle (3) and is disposed in an inner area of the frame (1), forming a space (4) between the limb (2) and frame (1) for accommodating a mop cloth (18);

Said screw type mop holder is characterized in that: a shaft (5) is disposed on a top of the frame (1) and a circular concavity (19) is set on an inner bottom of the shaft (5).

An opening (16) is disposed on a side of the frame (1); a hook (11) is disposed on a side of said opening (16), and a free end of said hook (11) corresponds with said opening (16).

A rail (17) is disposed on both sides of the limb (2), and a projecting bar (12) which corresponds with said rail (17) is disposed on both inner sides of the frame (1) for guiding the limb (2).

A tube (7) which fits into said shaft (5) is screw jointed onto an outer bottom of the handle (3); said tube (7) comprises a narrow and a wide opening (20, 21) which are disposed on a bottom and top of the tube (7) respectively. Pluralities of anti-slip stripes (13) are disposed on an outer top of the wide opening (21).

A wall (14) is disposed on where the wide opening (21) joins with the narrow opening (20) for contacting with a top surface of said shaft (5);

A circular projection (9), corresponding to said concavity (19) is disposed on a bottom of said tube (7); said projection (9) comprises pluralities of slots (8) around a side wall thereof, and a tapered surface (10) for guiding said tube (7) into the shaft (5) is disposed on an outer bottom of said projection (9);

Said projection (9) includes a bottom surface (15) on where said projection (9) joins with a side wall of the concavity (19), when said tube is fitted into the shaft (5);

By coupling the projection (9) and concavity (19), said tube (7) is fitted into the shaft (5) firmly and allowed to rotate freely therein.

By replacing the nut with a longer tube (7), a user can grip it with palm, reducing the pain and discomfort since the area has increased.

By fitting the tube (7) into the shaft (5) partially, said tube (7) is allowed to move freely in the shaft (5), said bearing-like structure reduces the force for tightening the tube (7), increasing the change speed of mop cloth and making the present invention an easy-to use tool.

DETAIL DESCRIPTION OF PREFERRED EMBODIMENT

Description of embodiments of the present invention are described in detail according to the appended drawings hereinafter.

First Embodiment

Figure 1:
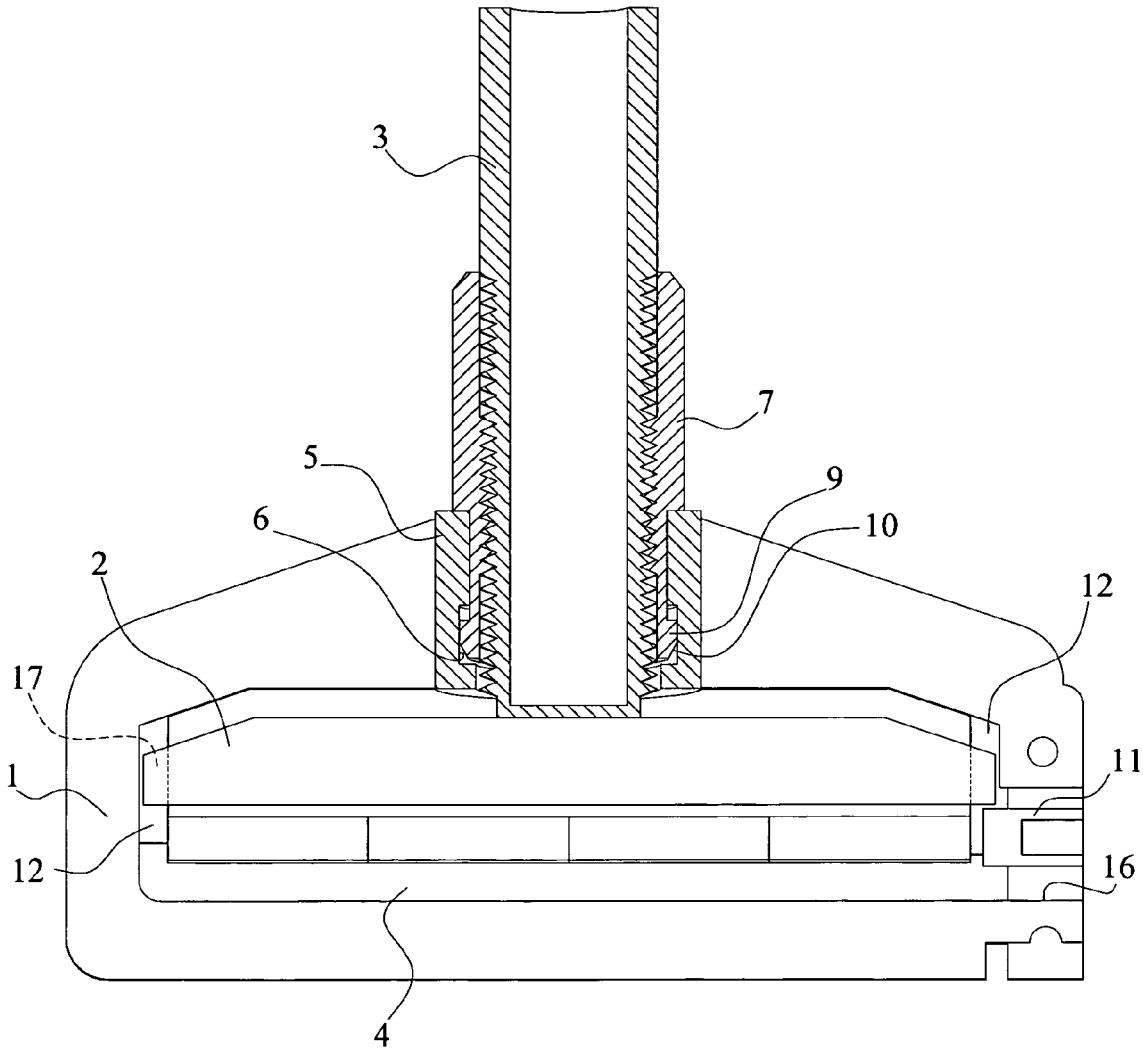
FIG. 1 is a cutaway view of the first embodiment of the present invention.
Figure 3:
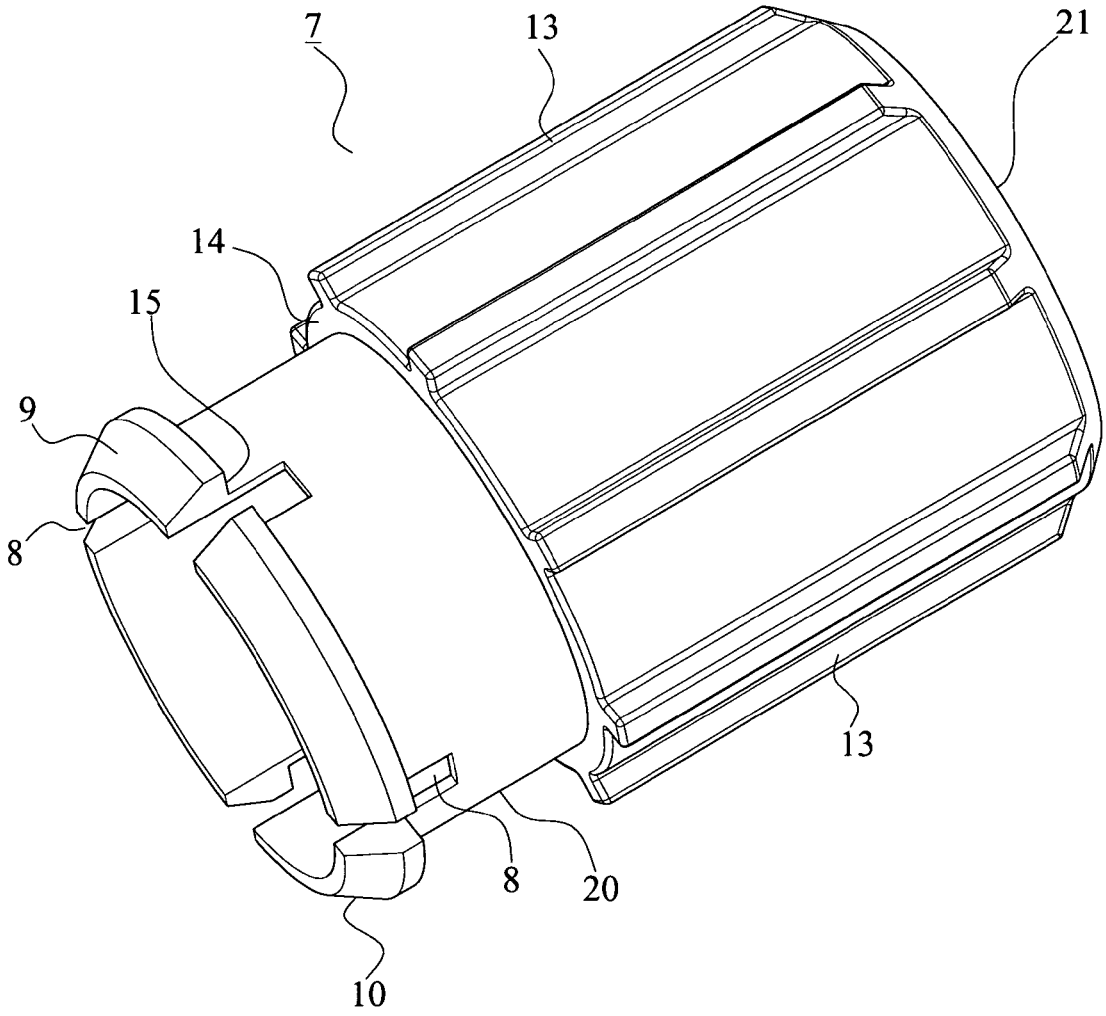
FIG. 3 is a schematic view of the tube.

As shown in FIGS. 1 and 3, a screw type mop holder comprises: a frame (1), a limb (2) and a threaded handle (3); said limb (2) is fixed to a bottom of the handle (3) and is disposed in an inner area of the frame (1), forming a space (4) between the limb (2) and frame (1) for accommodating a mop cloth (18).

Said screw type mop holder is characterized in that a shaft (5) is disposed on a top of the frame (1) and a circular groove (6) is set on an inner bottom of the shaft (5). A tube (7) which fits into said shaft (5) is screw jointed onto an outer bottom of the handle (3), and a circular projection (9), corresponding to said groove (6) is disposed on a bottom of said tube (7). Said projection (9) comprises pluralities of slots (8) around a cylindrical wall thereof, and a tapered surface (10) for guiding said tube (7) into the shaft (5) is disposed on an outer bottom of said projection (9). By coupling the projection (9) and groove (6), said tube (7) is fitted into the shaft (5) firmly and allowed to rotate freely therein.

Since the tube (7) is inserted partially and secured by the shaft (5), when the tube (7) is rotated by the user, the handle (3) is driven by the said rotation, and causing said limb (2) which is fixed to the bottom of the handle (3) to move relatively. When limb (2) moves upwardly, space (4) is extended to allow the user exchange the mop cloth (18) and when limb (2) moves downwardly, the space (4) is compressed and mop cloth (18) is secured on the frame (1).

The shaft (5) provides free rotating movement to the tube (7) when coupling and as interlocking mechanism to avoid disengagement of the tube (7). It can function as a bearing, thus, the user can rotate the tube (7) more easily without applying too much force.

The anti-slip stripes (13) disposed around the cylindrical wall of the tube (7) can increase the friction when said tube (7) contacts with the hand of the user, reducing slippery when rotating the tube (7).

Second Embodiment

Figure 2:
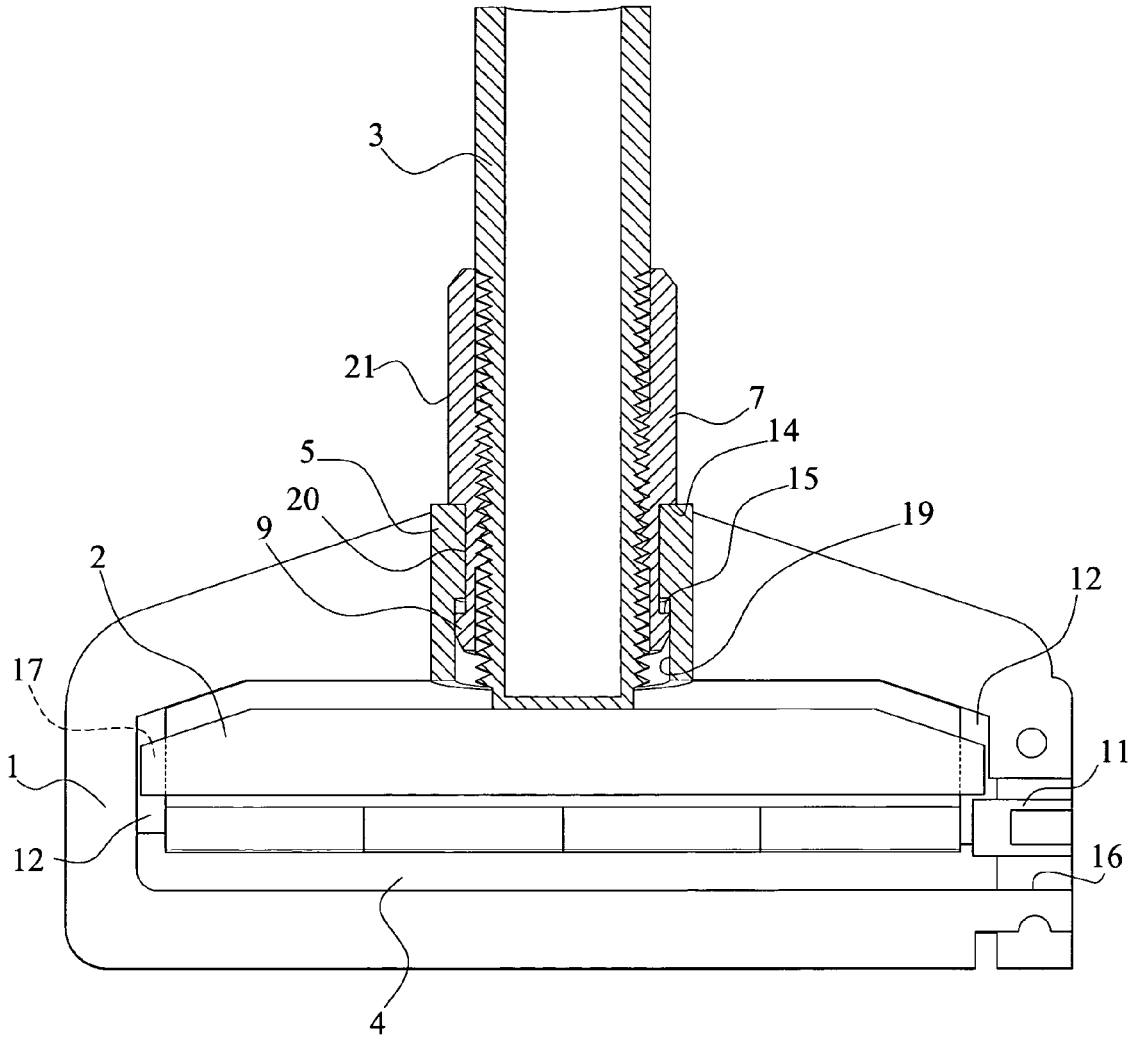
FIG. 2 is a cutaway view of the second embodiment of the present invention.

As shown in FIG. 2, an another screw type mop holder includes: a frame (1), a limb (2) and a threaded handle (3); said limb (2) is fixed to a bottom of the handle (3) and is disposed in an inner area of the frame (1), forming a space (4) between the limb (2) and frame (1) for accommodating a mop cloth (18).

Said screw type mop holder is characterized in that a shaft (5) is disposed on a top of the frame (1) and a circular concavity (19) is set on an inner bottom of the shaft (5).

A tube (7) which fits into said shaft (5) is screw jointed onto an outer bottom of the handle (3); said tube (7) comprises a narrow and a wide opening (20, 21) which are disposed on a bottom and top of the tube (7) respectively.

A wall (14) is disposed on where the wild opening (21) joins with the narrow opening (20) for engaging a top surface of said shaft (5);

A circular projection (9), corresponding to said concavity (19) is disposed on a bottom of said tube (7); said projection (9) comprises pluralities of slots (8) around a cylindrical wall thereof, and a tapered surface (10) for guiding Said tube (7) into the shaft (5) is disposed on an outer bottom of said projection (9). Said projection (9) includes a bottom surface (15) on where said projection (9) joins with a side wall of the concavity (19), when said tube (7) is fitted into the shaft (5).

By coupling the projection (9) and concavity (19), partial of said tube (7) is fitted into the shaft (5) firmly and allowed to rotate freely therein.

Unlike the groove (6) of the first embodiment, said concavity (19) can avoid damage of the projection (9) by applying excessive force against the wall of the groove (6). Moreover, concavity (19) is easier to be manufactured than the groove (6), which can reduce the manufacture cost.

Pluralities of anti-slip stripes (13) are placed vertically on the exterior of cylindrical wall of the wide opening (21) for increasing friction between user's hand and opening (21), same as the anti-slip stripes of first embodiment.

In both embodiments, an opening (16) is set on a side of the frame (1); and an end of a hook (11) is hinged at one end of said opening (16). A free end of said hook (11) can correspond with the other end of the opening (16).

Said opening (16) and hook (11) provide fast-installation of mop cloth (18). Once the limb moves upwardly, an user can extract the mop cloth (18) from the opening (16) by releasing the hook (11); and a new mop cloth (18) is inserted from the same opening (16), then the hook (11) is engaged afterward. After the limb (2) moves downwardly and holds the mop cloth (18), the exchange procedure is completed.

Further, in both embodiments, a rail (17) is disposed on both sides of the limb (2), and a projecting bar (12) which corresponds to said rail (17) is disposed on both inner sides of the frame (1) for guiding the limb (2).

By installing said rails (17) and projecting bars (12), the movement of the limb (2) is limited to move vertically, which ensures that force is applied equally to each spot of the mop cloth (18). They can also avoid the limb (2) disengage of said frame (1).

Figure 4:
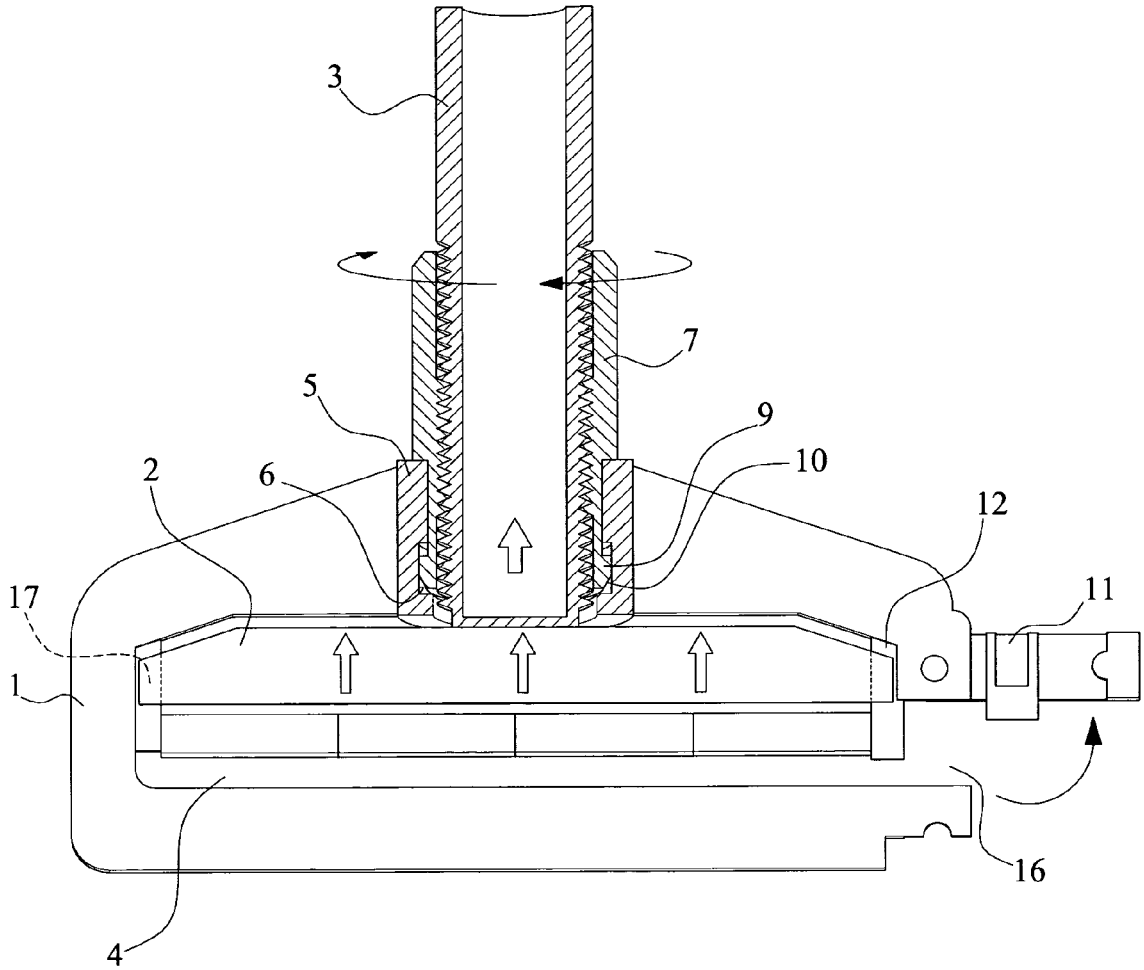
FIG. 4 is a schematic view of the first embodiment, illustrating disassembly of mop cloth.
Figure 5:
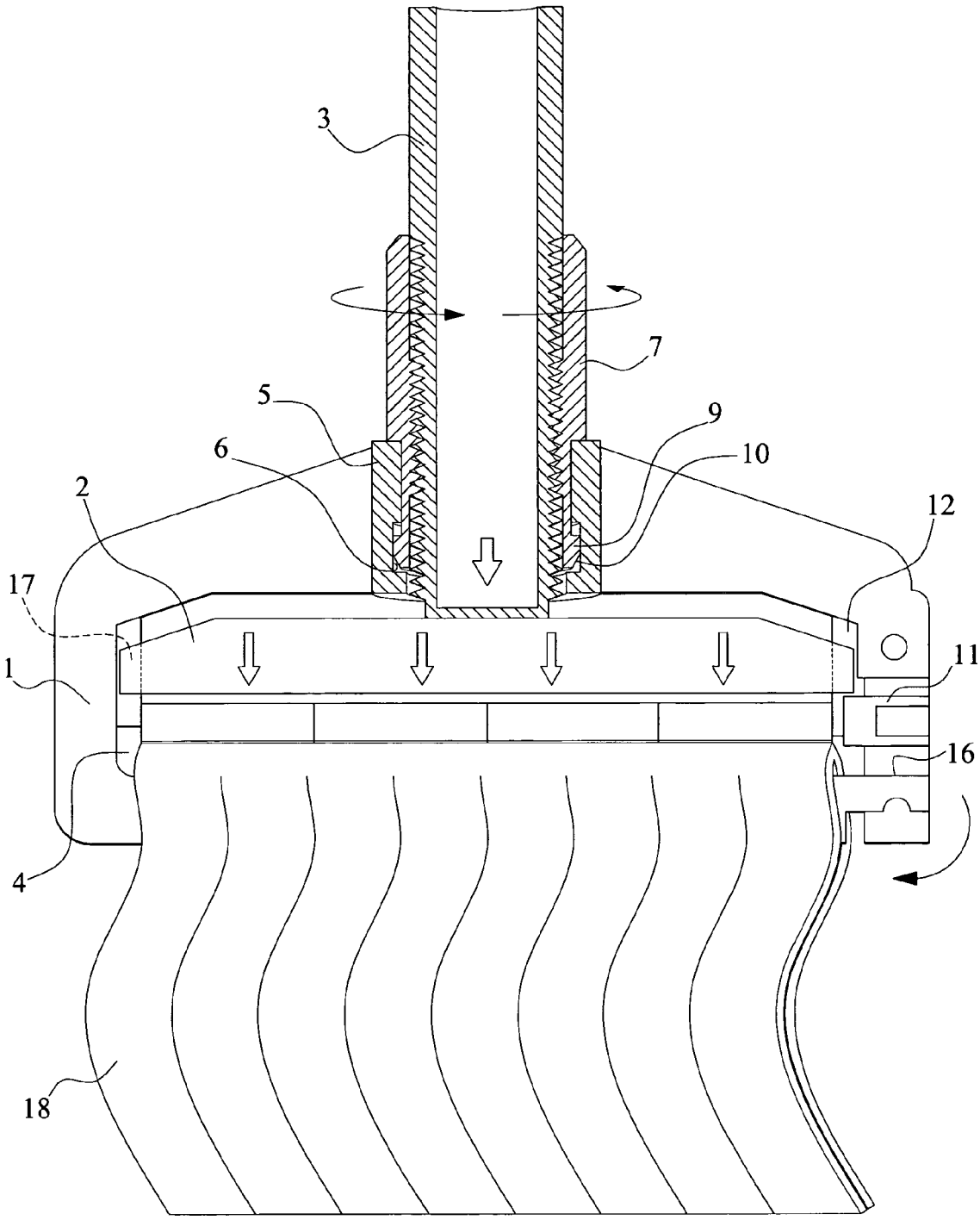
FIG. 5 is a schematic view of the first embodiment, illustrating assembly of mop cloth.

Referring to FIGS. 4 and 5, the function of both embodiments of the present invention are described. For placing a mop cloth (18), the hook (11) is released first. Afterward, the mop cloth (18) is inserted as shown in FIG. 5, then the hook (11) is locked on and the tube (7) is rotated to force the handle (3) moving downwardly and cause reaction of the limb (2) to press and secure the mop cloth. As for extraction of replacement, the procedure is executed reversely, the tube is rotated in counter-direction to lift the limb (2), once it disengages with the mop cloth (18), the hook (11) is released and the mop cloth (18) is extracted from the opening (16).

What is disclosed above are only the preferred embodiments of the present invention and it is therefore not intended that the present invention be limited to particular embodiments disclosed. It will be understood by those skilled in the art that various equivalent changes may be made depending on specification and drawings of present invention without departing from the scope of the present invention.

What is claimed is:

1. A screw type mop holder comprises: a frame (1), a limb (2) and a threaded handle (3); said limb (2) is fixed to a bottom of the handle (3) and is disposed in an inner area of the frame (1), forming a space (4) between the limb (2) and frame (1) for accommodating a mop cloth (18);

Said screw type mop holder is characterized in that a shaft (5) is disposed on a top of the frame (1) and a circular groove (6) is set on an inner bottom of the shaft (5);

A tube (7) which fits into said shaft (5) is screw jointed onto an outer bottom of the handle (3), and a circular projection (9), corresponding to said groove (6) is disposed on a bottom of said tube (7); said projection (9) comprises pluralities of slots (8) around a cylindrical surface thereof, and a tapered surface (10) for guiding said tube (7) into the shaft (5) is disposed on an outer bottom of said projection (9);

By coupling the projection (9) and groove (6), said tube (7) is fitted into the shaft (5) firmly and allowed to rotate freely therein.

2. A screw type mop holder of claim 1, wherein an opening (16) is disposed on a side of the frame (1); a hook (11) is disposed on a side of said opening (16), and a free end of said hook (11) corresponds with said opening (16).

3. A screw type mop holder of claim 1, wherein a rail (17) is disposed on both sides of the limb (2), and a projecting bar (12) which corresponds to said rail (17) is disposed on both inner sides of the frame (1) for guiding the limb (2).

4. A screw type mop holder of claim 1, wherein pluralities of anti-slip stripes (13) are disposed on an outer top of the tube (7).

5. A screw type mop holder comprises: a frame (1), a limb (2) and a threaded handle (3); said limb (2) is fixed to a bottom of the handle (3) and is disposed in an inner area of the frame (1), forming a space (4) between the limb (2) and frame (1) for accommodating a mop cloth (18);

Said screw type mop holder is characterized in that a shaft (5) is disposed on a top of the frame (1) and a circular concavity (19) is set on an inner bottom of the shaft (5);

A tube (7) which fits into said shaft (5) is screw jointed onto an outer bottom of the handle (3); said tube (7) comprises a narrow and a wide opening (20, 21) which are disposed on a bottom and top of the tube (7) respectively;

A wall (14) is disposed on where the wide opening (21) joins with the narrow opening (20) for engaging a top surface of said shaft (5);

A circular projection (9), corresponding to said concavity (19) is disposed on a bottom of said tube (7); said projection (9) comprises pluralities of slots (8) around a surface thereof, and a tapered surface (10) for guiding said tube (7) into the shaft (5) is disposed on an outer bottom of said projection (9);

A bottom surface (15) is disposed on said projection (9) where joins with a side wall of the concavity (19) for engaging said tube (7) with the shaft (5);

By coupling the projection (9) and concavity (19), said tube (7) is fitted into the shaft (5) firmly and allowed to rotate freely therein.

6. A screw type mop holder of claim 5, wherein an opening (16) is disposed on a side of the frame (1); a hook (11) is disposed on a side of said opening (16), and a free end of said hook (11) corresponds with said opening (16).

7. A screw type mop holder of claim 5, wherein a rail (17) is disposed on both sides of the limb (2), and a projecting bar (12) which corresponds to said rail (17) is disposed on both inner sides of the frame (1) for guiding the limb (2).

8. A screw type mop holder of claim 5, wherein pluralities of anti-slip stripes (13) are disposed on an outer top of the wide opening (21).

* * * * *